United States Patent [19]

Schulz

[11] Patent Number: 4,600,109

[45] Date of Patent: Jul. 15, 1986

[54] TRASH CAN RETAINER

[76] Inventor: Lowell V. Schulz, 1613 S. 110th St., Omaha, Nebr. 68144

[21] Appl. No.: 660,084

[22] Filed: Oct. 12, 1984

[51] Int. Cl.[4] ..... A47G 29/00

[52] U.S. Cl. ..... 211/71; 211/99; 248/DIG. 7

[58] Field of Search ..... 211/71, 13, 81, 84, 211/86, 88, 99, 182, 4 US; 248/DIG. 7; 24/512

[56] References Cited

U.S. PATENT DOCUMENTS

| | | | |
|---|---|---|---|
| 978,423 | 12/1910 | Zizinia | 211/99 |
| 2,158,986 | 5/1939 | Peshek et al. | 211/99 |
| 2,917,184 | 12/1959 | Beall | 211/81 |
| 3,028,015 | 4/1962 | Williams | 211/83 |
| 3,080,978 | 3/1963 | Gress | 211/71 |
| 3,191,960 | 6/1965 | Turner | 211/84 X |
| 3,224,595 | 12/1965 | Sherley | 248/DIG. 7 |
| 3,235,213 | 2/1966 | Hall | 248/DIG. 7 |
| 3,292,795 | 12/1966 | Chappell | 211/71 |
| 3,479,047 | 11/1969 | Bailey | 211/71 X |
| 3,547,273 | 12/1970 | Bompart | 211/84 |
| 3,907,117 | 9/1975 | Williams | 211/71 |

FOREIGN PATENT DOCUMENTS

| | | | |
|---|---|---|---|
| 359187 | 10/1931 | United Kingdom | 24/512 |
| 704256 | 2/1954 | United Kingdom | 24/244 |

*Primary Examiner*—Ramon S. Britts
*Assistant Examiner*—Sarah A. Lechok Eley
*Attorney, Agent, or Firm*—Zarley, McKee, Thomte, Voorhees & Sease

[57] ABSTRACT

A garbage can retainer includes a pair of spaced-apart side members having a top cross bar extended between upper edges thereof and a front cross bar extended between forward ends thereof. Rearward ends of the side members are hinged to an upright support structure for up and down pivotal movement of the apparatus between a lowered storage position wherein the top cross bar rests on the lids of cans positioned between the side walls and the front cross bar is positioned closely adjacent the front sides of the cans, and a raised access position wherein both the top and front cross bars are raised upwardly and rearwardly in clearance relation above the trash cans for convenient insertion and removal.

9 Claims, 5 Drawing Figures

TRASH CAN RETAINER

BACKGROUND OF THE INVENTION

The present invention is directed generally to an apparatus for securely supporting a trash can adjacent an upright support surface and more particularly to an apparatus for both holding the lids on a plurality of cans and preventing them from being tipped over by wind, animals and the like.

It is generally desirable to store garbage cans outdoors because of the occasional odors from the garbage and because of the storage space occupied by the cans. Unsupported garbage cans are likely to be tipped over by the wind or animals attracted by the smell of garbage in them with the result that garbage is scattered about and has to be picked up and placed back into the can. The presence of scattered garbage adjacent one's home is a very unpleasant sight and the task of cleaning it up is equally unpleasant.

Large fence-like enclosures for garbage cans shelter them from wind and animals but are often eyesores themselves. Portable trash can carts prevent the cans from being tipped over but the cans must be lifted into and from the carts and animals can remove the lids and scatter garbage from cans supported on such carts. Other structures have been devised for holding down the lid on a trash can but an animal could simply knock the can out from under the hold-down device to get at the garbage in the can.

A primary object of the present invention is therefore to provide an improved trash can retainer which is operative to both hold the lid on a garbage can and prevent it from being tipped over.

Another object is to provide a garbage can retainer which is readily pivoted upwardly away from the cans for convenient access to the cans.

Another object is to provide a garbage can retainer which does not interfere with removal of the cans with the lids on them.

Another object is to provide a garbage can retainer wherein cans can simply be pushed into and from the retainer without need for lifting the cans.

Another object is to provide a garbage can retainer with a self-latching mechanism for releasably securing the retainer in a raised access position above the cans.

Finally, an object is to provide a garbage can retainer which is simple and rugged in construction, economical to manufacture, attractive in appearance and efficient in operation.

SUMMARY OF THE INVENTION

The garbage can retainer of the present invention includes a pair of upright spaced-apart side members having a top cross bar extended between upper edges thereof at an intermediate position between the forward and rearward ends of the side members. A front cross member is connected between the forward ends of the side members at a position below and forwardly of the top cross member. A hinge at the rearward end of the side members is adaptable for pivotal connection to an upright support structure for pivotal movement of the apparatus between a lowered storage position wherein the top cross member rests on the closed lid of a garbage can situated between the side members and the front cross member limits forward movement of the can, and a raised access position wherein both the top and front cross members are raised upwardly and rearwardly in clearance relation above the trash can. A self-actuating latch may be provided on the support structure for releasably securing the apparatus in its raised access position for convenient insertion and removal of cans between the side members.

The side members are spaced sufficiently apart for receiving one or more garbage cans in side-by-side relation therebetween. When the apparatus is pivotally lowered to its storage position, its weight is applied by the top cross member to bear down on the lids to hold them on the cans. The close association of the front cross member and side members to the sides of the cans prevent them from being tipped over. The apparatus may be simply and attractively constructed of tubular members to provide a garbage can retainer which is attractive in appearance and effective in operation.

DESCRIPTION OF THE PREFERRED EMBODIMENTS

Figure 1:
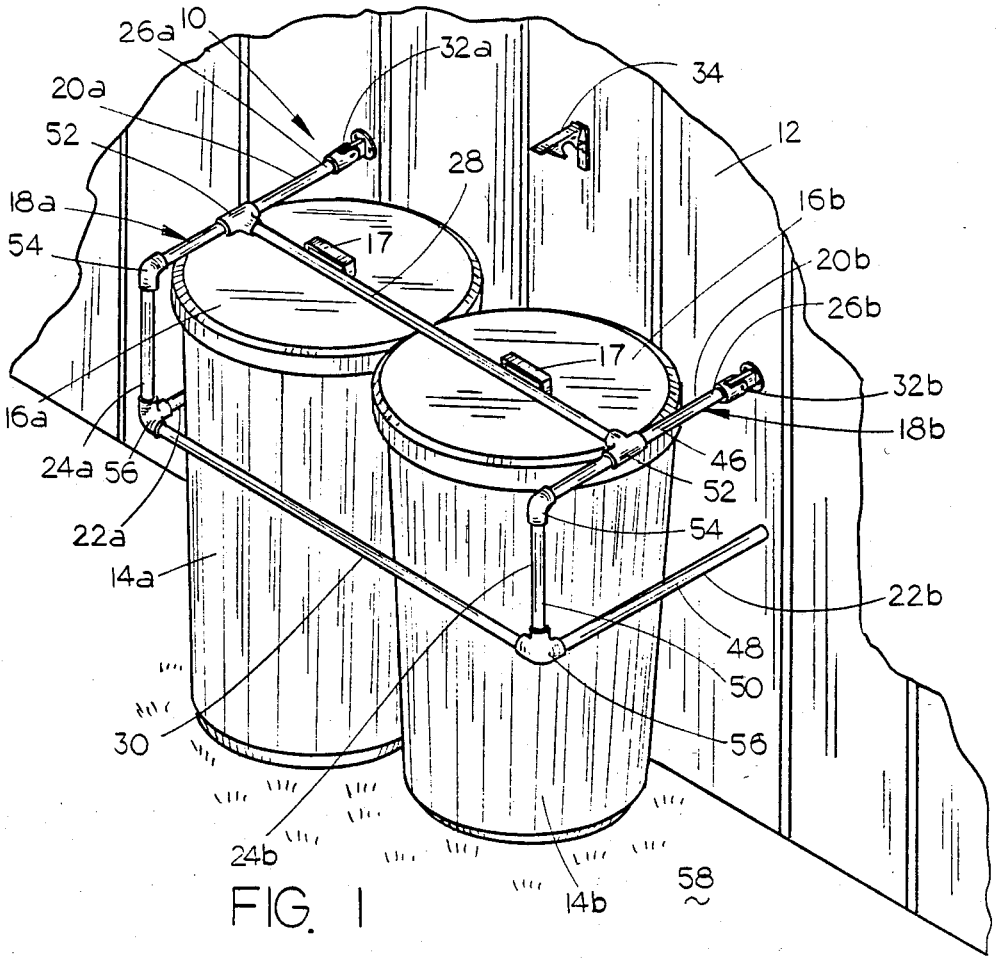
FIG. 1 is a perspective view of a pair of garbage cans retained in the apparatus of the invention.
Figure 2:
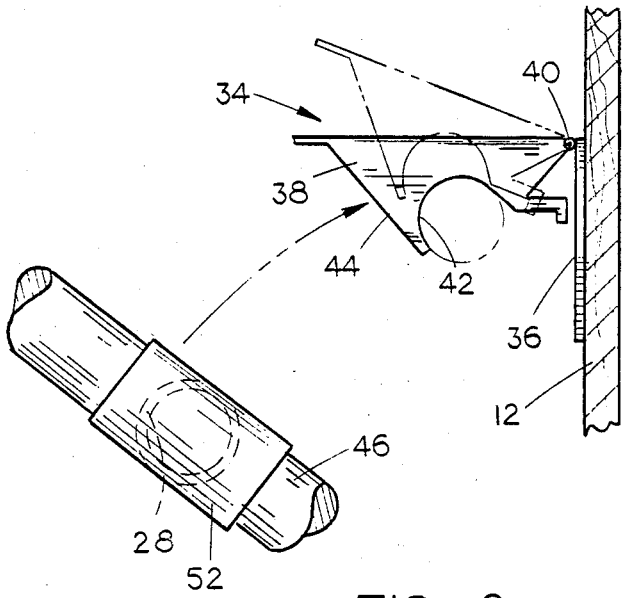
FIG. 2 is an enlarged detail side view of the self-actuating latch of the invention.

The trash can retainer 10 of the present invention is shown in FIG. 1 mounted on an upright support structure 12 such as the wall of a building, in a position for supporting a pair of garbage cans 14*a* and 14*b* and holding the respective lids 16*a* and 16*b* on them.

Retainer 10 includes a pair of side walls 18*a* and 18*b*, each having respective upper and lower edges 20*a*, 20*b* and 22*a*, 22*b* forward and rearward ends 24*a*, 24*b* and 26*a*, 26*b*.

A top cross bar 28 is connected to and extended between the side members 18*a* and 18*b* adjacent the upper edges 20*a*, 20*b* thereof at positions intermediate the forward and rearward ends of the side members.

Likewise, a front cross member 30 is connected to and extended between the side members 18*a* and 18*b* adjacent the forward ends 24*a*, 24*b* thereof at a position below and forwardly of top cross bar 28 when the retainer is in the lowered storage position shown in FIG. 1.

Figure 3:
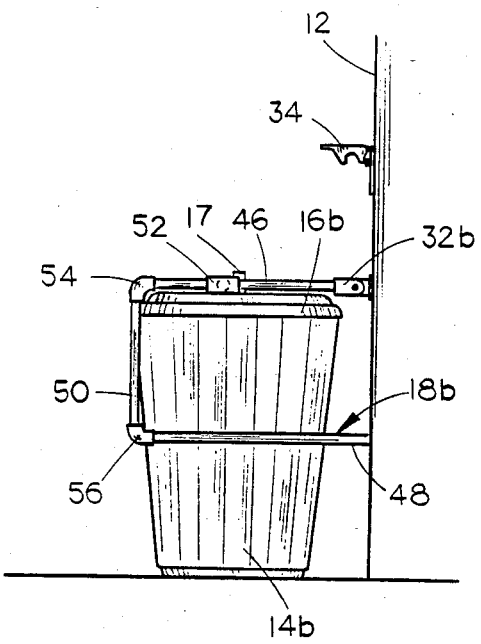
FIG. 3 is a side elevational view of the apparatus in the lowered storage position thereof.
Figure 4:
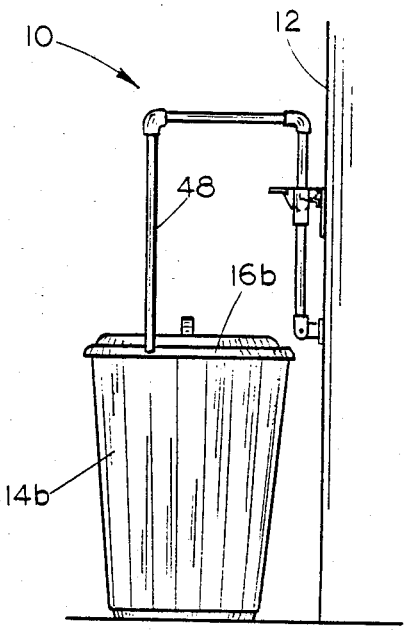
FIG. 4 is a side elevational view of the apparatus in the raised access position thereof.

The rearward ends 26*a*, 26*b* of the side members 18*a*, 18*b* are pivotally connected to the support wall 12 by a pair of hinged connectors 32*a*, 32*b* for pivotal movement of the apparatus between the lowered storage position of FIGS. 1 and 3 and the raised access position of FIG. 4.

A self-actuating latch 34 is provided for releasably securing the apparatus in the raised access position. Latch 34 includes a base plate 36 adapted for securement to the support structure 12 by adhesives, screws or the like. A forwardly extended latch member 38 is pivotally connected to the base plate as at 40 and includes an open bottomed recess 42 situated just rearwardly of an upwardly and forwardly inclined engagement surface 44. The base plate is mounted at an elevation for engagement of engagement surface 44 by the top cross bar 28 when the apparatus is raised to the access position. The inclination of the engagement surface 44 is such that it is pivoted upwardly by the top cross bar 28 in clearance relation above the top cross bar whereupon it falls by its own weight to releasably retain the top cross bar in recess 42. To release the latch, it is a simple matter of raising the latch member 38 to disengage the top cross bar from the recess 42. A spring may be provided for urging the latch member 38 downwardly but such an accessory is unnecessary and subject to loss and breakage.

In the preferred embodiment of the invention, the side walls 18*a* and 18*b* are constructed as mirror images of one another. Accordingly, only side wall 18*b* is described in detail with like numerals referring to similar parts of each. The side member 18*b* is preferably formed as a generally C-shaped assembly of tubular members including top and bottom side rails 46 and 48 interconnected by an upright front rail 50. The top and front cross members 28 and 30 are preferably made of similar tubular material such as electrical conduit or PVC pipe. The top side rail 46 may be provided as two parts for connection to the top cross bar 28 by a conventional T-fitting 52. A conventional elbow fitting 54 connects the top side rail 46 to the front rail 50 and a three-way elbow fitting 56 connects the front rail 50 to both the bottom side rail 48 and front cross bar 30.

The connection of the tubular members to the various fittings can be by any conventional means including adhesives for PVC pipe, set screws through the fittings, or threaded fittings in tubes. For ease of assembly, however, it is preferred that the openings of each fitting are provided with a conventional compression connector including a nut and collar to be slipped onto the adjacent tubing for a threaded connection to the fitting to securely grip the tube therein.

Accordingly, the apparatus can be easily assembled and mounted by a homeowner with only a few commonly available tools.

In operation, the various parts of the retainer 10 are first assembled. The various side rails and top and front cross bars may be provided in oversize lengths so that they may be cut to size to precisely fit and hold a particular set of garbage cans. As shown in FIG. 1, it is preferred that the top and front cross members be cut to a length such that the spacing between the side members 18*a* and 18*b* just slightly exceed the spacing required for receiving the cans 14*a* and 14*b* therebetween. Likewise, the side rails 46 and 48 are cut to a length such that the front cross member 30 will be situated closely adjacent the front edge of the can. Finally, the front rails 50 are cut to a length such that the front cross member 30 and bottom side rails 48 are disposed at a height approximately halfway between the top cross bar 28 and can support surface such as ground 58. The hinged connectors 32*a* and 32*b* are then secured to the upright support structure at approximately the height of the cans. The top cross bar 28 may be positioned slightly forwardly of the centered position between the forward and rearward ends of the side walls for engaging the lid handles 17 in parallel relation as shown in FIG. 1. This tends to prevent twisting movements of the cans for a more secure hold. The bottom side rails 48 are preferably of a length to limit downward pivotal movement of the apparatus to approximately the lowered storage position thereof shown in FIG. 3. The bottom side rails 48 may be slightly shortened to assure that the weight of the apparatus does bear down on the can lids.

Figure 5:
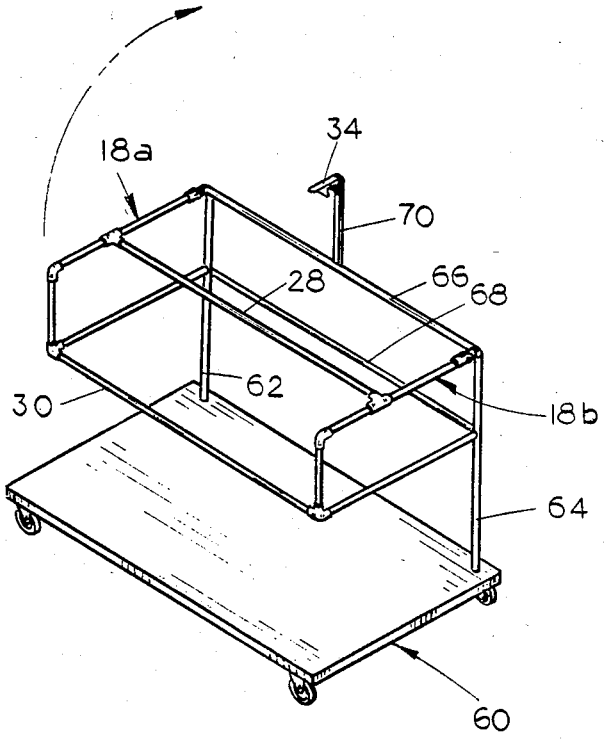
FIG. 5 is a perspective view of an alternate embodiment of the invention including a portable cart.

An alternate embodiment of the invention is shown in FIG. 5 wherein the upright support structure 12 is provided in the form of a wheeled platform 60 having a pair of upright posts 62 and 64 connected together by upper and lower rear cross bars 66 and 68 with an upright center post 70 for supporting latch 34.

The pivotal connection of the top side rail to the support structure serves the additional function of resisting direct vertical movement of the apparatus. This is at least partially attributable to the rearwardly offset position of the top cross member relative to the front of the apparatus. Thus the design of the apparatus contributes additional resistance to lifting of the garbage can lids over and above that provided by the weight of the apparatus alone.

Thus there has been shown and described a garbage can retainer which accomplishes at least all of the stated objects.

I claim:

1. An apparatus for securing and supporting a trash can having a removable lid, comprising, a pair of upright spaced-apart side members having upper and lower edges and forward and rearward ends, said side members adapted for placement on opposite sides of a trash can situated adjacent an upright support structure, means for pivotally connecting the rearward end of each side member to the upright support structure for up and down pivotal movement of the side members between a lowered storage position on opposite sides of a trash can and a raised access position, a top cross bar rigidly connected to and extended between said side members adjacent the upper edges thereof and positioned between the forward and rearward ends thereof for resting on a trash can lid upon movement of said side members to the lowered storage positions thereof, a front cross member rigidly affixed between said side members adjacent the forward ends thereof, said front cross member being situated lower than and forwardly of said top cross member to limit forward movement of a trash can situated between said side members in the lowered storage positions thereof, and said top and front cross bars being raised upwardly and rearwardly in clearance relation above the lid of the trash can in response to pivotal movement of the side members from the lowered storage position to the raised access positions thereof.

2. The apparatus of claim 1 wherein the spacing between said side members is at least approximately twice the fore and aft depth of said side members to thereby accommodate the placement of at least a pair of trash cans between said side members.

3. An apparatus for securing and supporting a trash can having a removable lid, comprising, a pair of upright spaced-apart side members having upper and lower edges and forward and rearward ends, said side members adapted for placement on opposite sides of a trash can situated adjacent an upright support structure, and wherein each side member has a generally C-shape including top and bottom side rails interconnected by an upright front rail, means for pivotally connecting the rearward end of each side member to the upright support structure for up and down pivotal movement of the side members between a lowered storage position on opposite sides of a trash can and a raised access position, a top cross bar connected to and extended between said side members adjacent the upper edges thereof and positioned between the forward and rearward ends thereof for resting on a trash can lid upon movement of said side members to the lowered storage positions thereof, a front cross member connected to and extended between said side members adjacent the forward ends thereof, said front cross member being situated lower than and forwardly of said top cross member to limit forward movement of a trash can situated between said side members in the lowered storage positions thereof, and said top and front cross bars being raised upwardly and rearwardly in clearance relation above a trash can in response to pivotal movement of the side members to the raised access positions thereof.

4. The apparatus of claim 3 wherein the lower side rail is of a length such that the rearward end thereof is situated adjacent the upright support structure upon movement of the side members to the lowered storage positions thereof to thereby limit downward pivotal movement of the side members to approximately the lowered storage positions thereof.

5. The apparatus of claim 3 wherein each end of the front cross member is connected to the adjacent front rail and lower side rail by a three-way elbow fitting.

6. The apparatus of claim 5 wherein said front rail of each side member is connected to the top side rail by an elbow fitting and the top side rail is connected to one end of the top cross bar by a T-fitting.

7. The apparatus of claim 1 further comprising a latch means adapted for securement to the upright support structure at a position for engagement by said top cross bar in response to movement of the side members to the raised access positions thereof, said latch member being operative to releasably latch and hold the top cross member in response to engagement thereby.

8. The apparatus of claim 7 wherein said latch comprises an upright base plate, a forwardly extended latch member pivotally connected to the base plate, said latch member having an open bottomed recess for receiving the top cross member and an upwardly and forwardly inclined engagement surface situated forwardly of the recess for pivotally raising the latch member in response to engagement of the top cross member against said engagement surface.

9. The apparatus of claim 1 wherein said upright support structure comprises upright posts on a wheeled platform situated forwardly of the posts for supporting a trash can.

* * * * *